US007134399B1

(12) United States Patent
Gulsby

(10) Patent No.: US 7,134,399 B1
(45) Date of Patent: Nov. 14, 2006

(54) SEAM GAUGE

(76) Inventor: Alma J. Gulsby, 2604 Lloyds La., Mobile, AL (US) 36693

( * ) Notice: Subject to any disclaimer, the term of this patent is extended or adjusted under 35 U.S.C. 154(b) by 196 days.

(21) Appl. No.: 10/775,558

(22) Filed: Feb. 10, 2004

Related U.S. Application Data

(60) Provisional application No. 60/450,833, filed on Feb. 28, 2003.

(51) Int. Cl.
*D05B 35/08* (2006.01)

(52) U.S. Cl. ..... 112/475.03; 112/139; 112/235

(58) Field of Classification Search ..... 112/475.01, 112/475.03, 475.05, 136, 137, 139, 147, 151, 112/153, 235, 240, 470.33; 83/37, 910, 937–939
See application file for complete search history.

(56) References Cited

U.S. PATENT DOCUMENTS 1,637,804 A * 8/1927 Brooks ..... 112/139
2,003,665 A * 6/1935 Karle ..... 112/151
2,094,918 A * 10/1937 Greist et al. ..... 112/139
2,494,182 A * 1/1950 Lang ..... 112/235
2,581,603 A * 1/1952 Rockerath ..... 112/235
2,682,844 A * 7/1954 MacPherson ..... 112/139
2,737,914 A * 3/1956 Hofgesang ..... 112/139
3,150,621 A * 9/1964 Warnock ..... 112/470.33
4,359,955 A * 11/1982 Hida ..... 112/240

* cited by examiner

*Primary Examiner*—Ismael Izaguirre

(57) ABSTRACT

A device is taught for holding a sew cord or corded piping while it is cut and for manufacturing sew cord with a desired seam allowance. The device incorporates an adjustable seam allowance by providing notches cut for holding the sew cord after or during stitching and during the cutting of the seam allowance. Various methods of adjusting the length of the seam and automating the process include having variable distance cuts, having a reduced side for tracking a cutting blade incorporating the device into a presser and incorporating a cutting blade in the product.

24 Claims, 12 Drawing Sheets

SEAM GAUGE

PRIORITY

This patent claims priority in U.S. Provisional Patent No. 60/450,833 filed Feb. 28, 2003 to Alma Johnson Gulsby.

BACKGROUND OF INVENTION

1. Field of Invention

The invention applies to sewing aids. More specifically the invention applies to devices for setting corded piping a desired spacing.

2. Prior Art

Corded piping historically is made when a strip of fabric is cut wide to cover the filler cord (or cords) and extending long enough to allow the seam allowance and trim waste. The fabric is then folded in half by the longest dimension and the filler cord is inserted in the fold. It is then sewn by the machine, usually immediately adjacent to the cord. Trimming or grading the seam to the seam width desired is accomplished by one or two prior art methods typically.

After making the corded piping, one has to measure and mark the seam allowance by using scissors to cut along the marked line cutting off the excess fabric. This is the most accurate prior art way to make corded bias piping.

Another method is to cut the fabric twice the width of the finished seam allowance plus the diameter of the filler cord used to make the piping. When sewing with this method, it is necessary to be very careful to make sure the cut edges of the fabric are lined exactly and that one knows exactly the diameter of the filler cord. The method can only be used when making piping with fabric cut on the straight of the grain. This is not an accurate method to use when making bias corded piping because the fabric stretches, becoming narrower after it is assembled when sewing in the cord and thereby losing the accuracy of the seam allowance.

GENERAL DISCUSSION OF THE INVENTION

Corded piping or sew cords are decorative fabric covered cord sewn into or adjacent to a seam. Corded piping is a fabric covered cord which typically has a seam allowance attached for purposes of sewing it together with an outfit. The cord is used as a filler to make a rounded ridge at the fold of the fabric; and this fold allows for the cord to be held within the corded piping or sew cord.

There are several types of corded piping. One is bias piping. Bias fabric strips are cut on a forty-five degree angle to the fabric straight of grain. Bias piping is flexible, allowing it to be sewn around curves and remain flat.

The second basic type of corded piping is straight of grain piping. Fabric strips are cut on fabric straight of grain. Straight of the grain piping is not flexible. It cannot be sewn around curves. It is used on straight edges when a non stretch edge is needed for durability.

There are several reasons to use piping. Piping is used to accent seams and or stiffen edges. It adds a fashionable and inexpensive accent to seams. Corded piping can be added to any edge where seams are joined. To add durability, corded piping will help hold an over stuffed cushion together. Upholstered boat seats are over stuffed and tufted in a diamond tuck and roll configuration for comfort and durability. Adding corded piping helps prevent the stuffing from migrating and maintains cushion shape. Upholstered chair and couch cushions benefit when corded piping is used in edge seams to make the edges crisp and help to prevent the cover from shifting keeping the cushion neat and adding durability and strength to the edges.

Piping is used on clothing, upholstery, home decorations, fashion accessories, car and boat seats, and mattresses as examples. In garment construction corded piping is used to accent seams. Corded piping is used in garment construction when the edge of a garment needs to be turned with a sharp finish as in a collar or lapel of a jacket or coat or when pattern pieces are joined and corded piping is inserted in the seam as part of the overall design. In upholstery piping is used to define the edges of furniture detail and stiffen cushion edges. In home decorations corded piping is used in window valances, decorative cushions, quilts, duvets, etc. It can also be used on purses and shoes in order to add strength, support or for decorative purposes.

Piping can be relatively inexpensive to make, but it can be time consuming unless there is a way to adjust the seam allowances properly.

It is a desirable accent as it provides visual and dimensional texture. Piping can be made of the same fabric as the project or a complimentary color. It can be made with the same allowance to equal the seam allowances of the pattern pieces. It can be an easy method of modifying existing patterns.

The only piping made available to the home seamstress is made of stiff fabric with a ¼ seem allowance in limited colors. By allowing for the manufacture of seam allowances by the seamstress, or tailor a great deal more variety is allowed.

If patterns may be used with a seam allowance of other than ¼ inch. All pattern pieces or piping used must be trimmed to a ¼ inch which is one reason why it is difficult to make assemblies with of the shelf seam allowance materials. If the seam allowance is not trimmed one must measure the distance when sewing the piping to the pattern piece which is an extremely time consuming and inaccurate method of putting together patterns.

When all the elements of a garment or upholstery are assembled, unless one maintains an accurate seam allowance, the pieces which make up the project will not fit together correctly. The present device is made to be used with a rotary cutter 60 preferably which has a sharp edge 57 and a roller 61 where the roller can move along the edge 8 of the seam gauge 7. Alternatively, a mark can be made along the line defined by the edge 8 of the seam gauge. The invention is used by cutting fabric for piping using a chart for approximate fabric width. Fabric width does not have to be exact. Extra seam width is needed for trimming.

The wider the seam width, the better, for an easier trim. For a minimum seam allowances, a ¼ inch seam should be cut 1 and ¼ inch wide, a ½ inch seam should be cut 2 inches wide, a ⅜ inch seam should be cut 2 inches wide, and a ⅝ inch seam should be cut 2 and ½ inches wide.

Once the cord is in place, the user will place the piping on the cutting mat and align the groove of the seam gauge for the desired seam allowance over the piping. Typically the piping seam allowance is cut from the bottom to the top although the direction of the cut is largely discretionary.

The user continues cutting the open perimeter marking if it is going to be marked, for later cutting, and sliding the seam gauge along the piping cord.

It is also helpful to spray starch thin, soft or silky fabric before cutting bias strips. Starching stabilizes the bias. Where starch is not used, it is helpful to cut the strips 1 inch wider than the suggested width. It is a good idea to stretch the fabric as the piping is sewn. Stretching helps to make a snug fit to prevent wrinkles from fabric shifting when sewing the piping. Fabric edges do not have to be even before trimming, but at least one fabric layer should be wide enough for trimming to the desired seam width. This stretching is easier because the piping holds the sew cord while it is stretched and stitched in certain embodiments. It can be helpful to use an adjustable zipper foot to move the needle close to the inside curve and the zipper foot. Using a 3 mm to 3.5 mm stitch length the user can stitch the bias around the cord. There should be a little ease between the stitching line and the cord. When attaching (basting) piping to the project, the same stitching line can be used. The machine needle is moved closer to the edge of the foot when sewing the final seam. The original stitching should be enclosed within the seam allowance.

It is therefore a purpose to provide a seam guide for holding seam and piping for later attachment. A further purpose of this is to provided for faster, more accurate seam allowance cutting and also to allow for a choice of multiple seam allowances.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EXEMPLARY EMBODIMENTS

Figure 1:
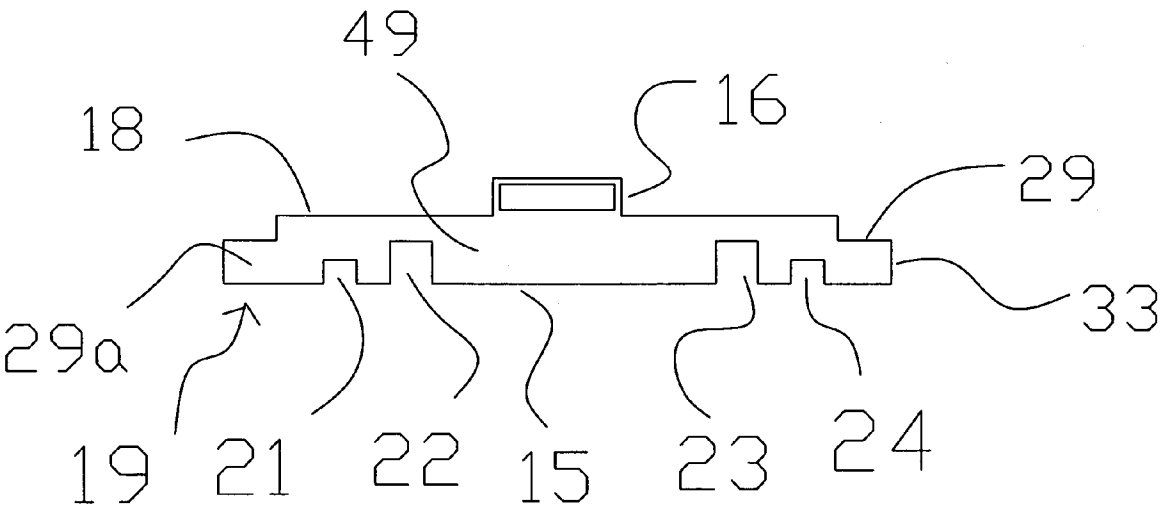
FIG. 1 shows a front view the front cross sectional view of the preferred embodiment.
Figure 2:
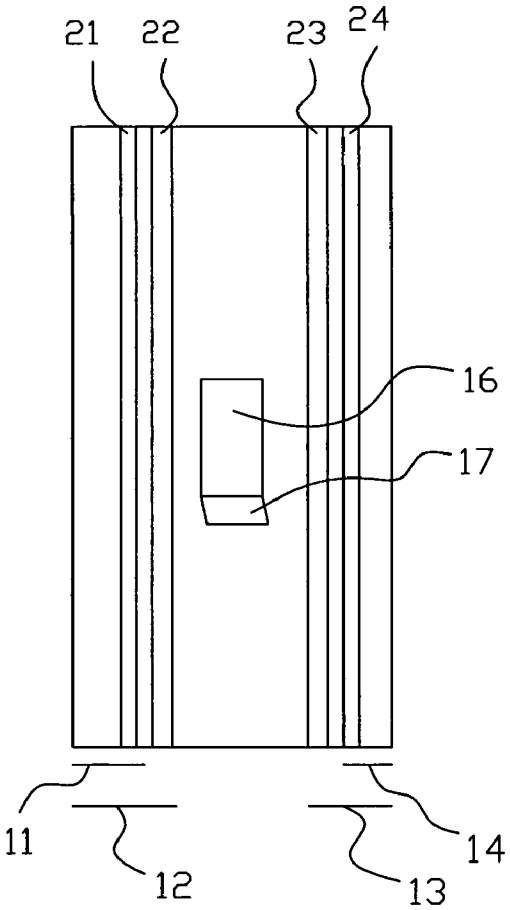
FIG. 2 shows a top view of the embodiment showed in FIG. 1.
Figure 5:
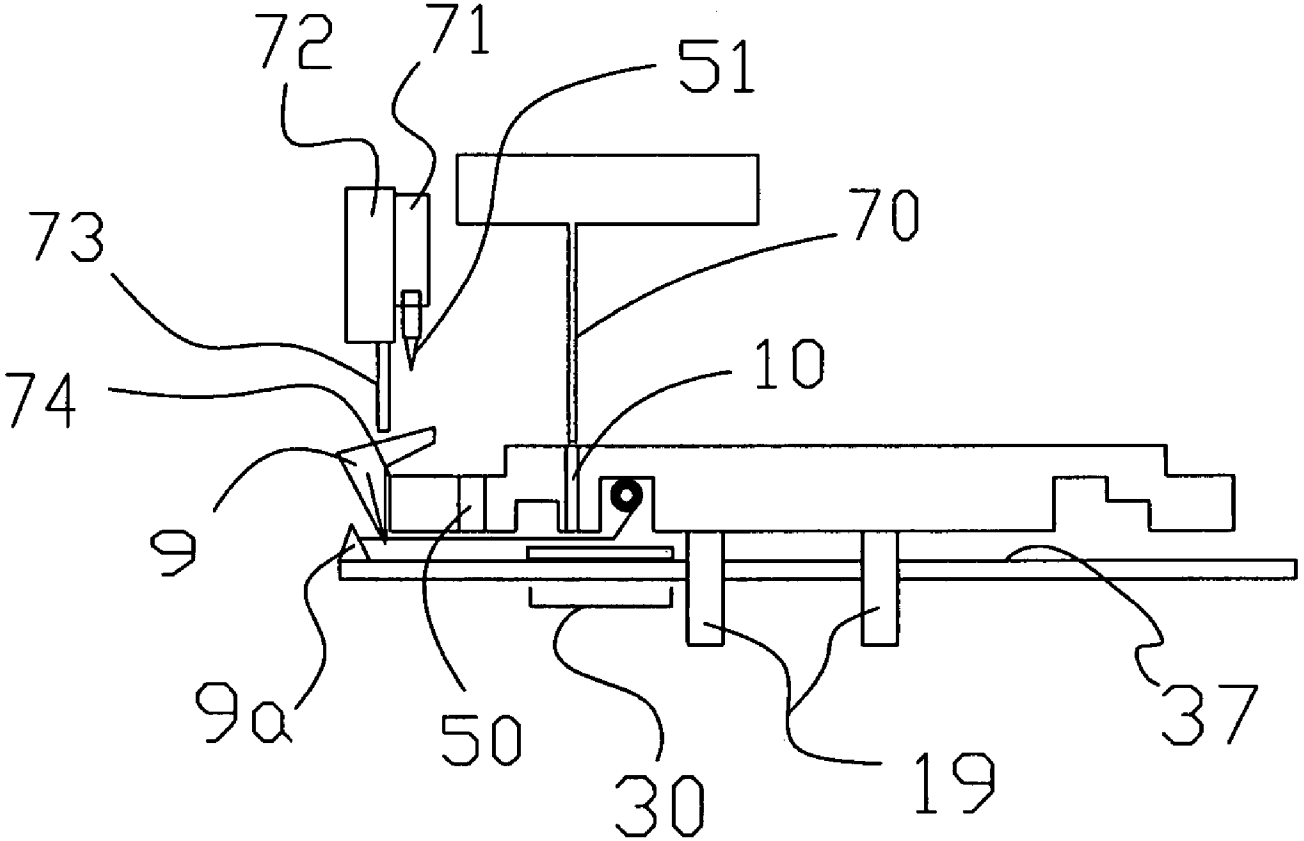
FIG. 5 shows a side cross sectional view of a alterative embodiment.
Figure 7:
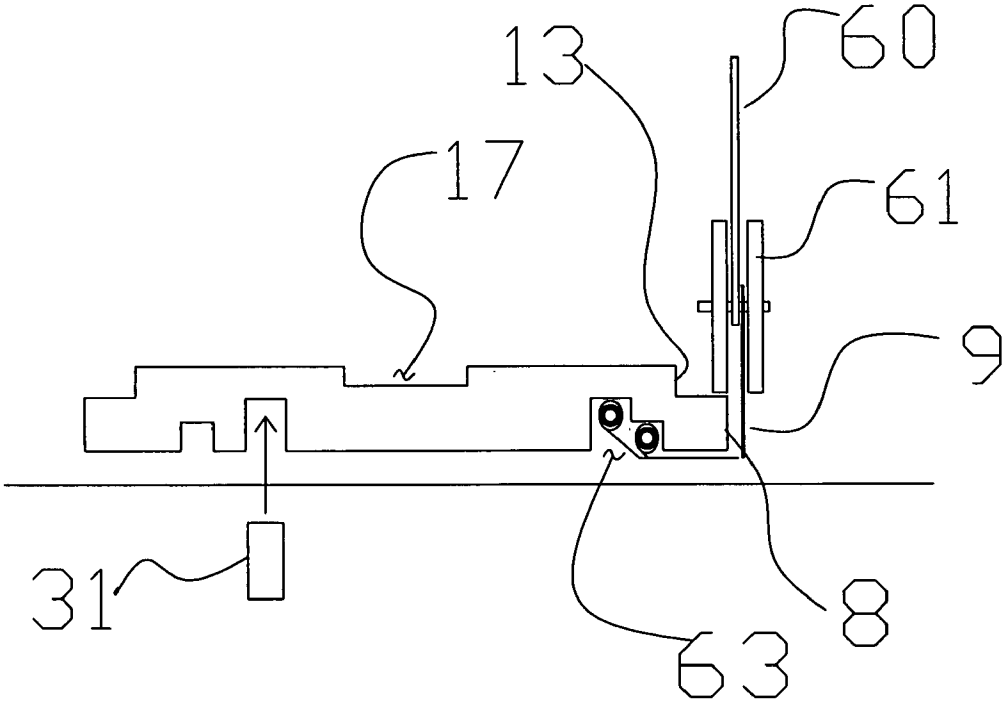
FIG. 7 shows a side view of another alternate embodiment showing the movement of a rotary cutter in conjunction with the product.

Referring to FIG. 1, it can be seen that the product comprises a base 15 which may have a handle 16 or an indention 17 as shown in FIG. 7 for a hand or finger to grip or as an attachment means for attaching the product to a machine as shown in FIG. 5.

Figure 3:
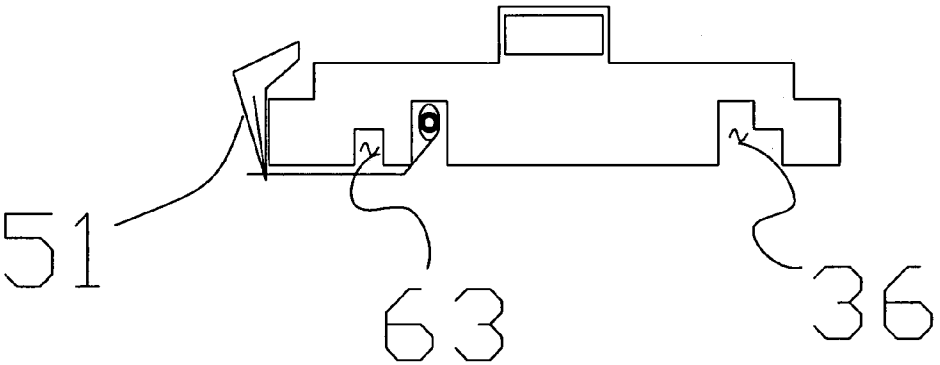
FIG. 3 shows side cross sectional view of one alternate embodiment.

This base 15 has a top surface 18 where the handle or indention may be provided for and also has a bottom surface 19 along the base 15 which defines, in this embodiment, four separate notches 21, 22, 23, and 24 which preferably have a width which is approximately equal to the width 30 of the sew cord 6 which would fit into the particular notch, here notch 22 in FIG. 3. Inserts 31 as shown in FIG. 7 may be used in order to reduce the diameter of the notches (here notch 22) where smaller sew cords might be incorporated into the product.

On the edge or side 33 of the base is a reduced depth section 29 which allows for an edge of a cutting knife or for the users hand to move along the top section 32 of this reduced depth section 29 so that a straight cut can be made utilizing the sharp right angle straight side 33 between the reduced section top 32 and the base 15. A second reduced depth section 29*a* is available on the other side as well, so that more seam allowance dimensions may be allowed than would be possible if only a left side or a right side was available.

In this case, the seam allowances (and hence the distances from the notches to the edges) on the left are a ¼"–3/8" and on the right are ½" and 1", although it is obvious that metric measurements and slightly different measurements could be utilized without departing from the invention concept embodied herein.

The particular invention which is shown in FIG. 1 allows for the seam cord to be continuously cut along any length of material. In the preferred embodiment the invention is cut into a body 49 which is preferably of a clear and cuttable material (plastics work well) which is carved to provide a plurality of notches 21–24 running the length of body 49 through which the cord may run and against the edges 33 of the body and be a cut with a blade 51.

The length of the seam allowance 5 is crucial in the construction when the sew cord 6 comprised of cord 1 and fold 2 is attached to the base material 11 with base stitches 12 in order to obtain the desired overall effect.

The prior art is full of examples of various locations where a sew cord is utilized in connection with an outfit. In some cases, joined sew cords 8 are utilized in order to obtain a particular effect.

In all these cases, the seam allowance 5 is critical in the overall appearance of the item.

Another improvement is where two separate sew cords 6 are provided and previously attached at attachment points and in this case one is lower than the next by virtue of the design. In order to accommodate this, instead of two adjacent notches, there is a double notch 36 as shown in FIGS. 3, 3*a* and 7 for the larger sew cord 38 and which defines a smaller adjoining notch for the smaller sew cord 40 so that one product may be made with two (or more) sew cords in FIG. 3*a*.

Figure 3A:
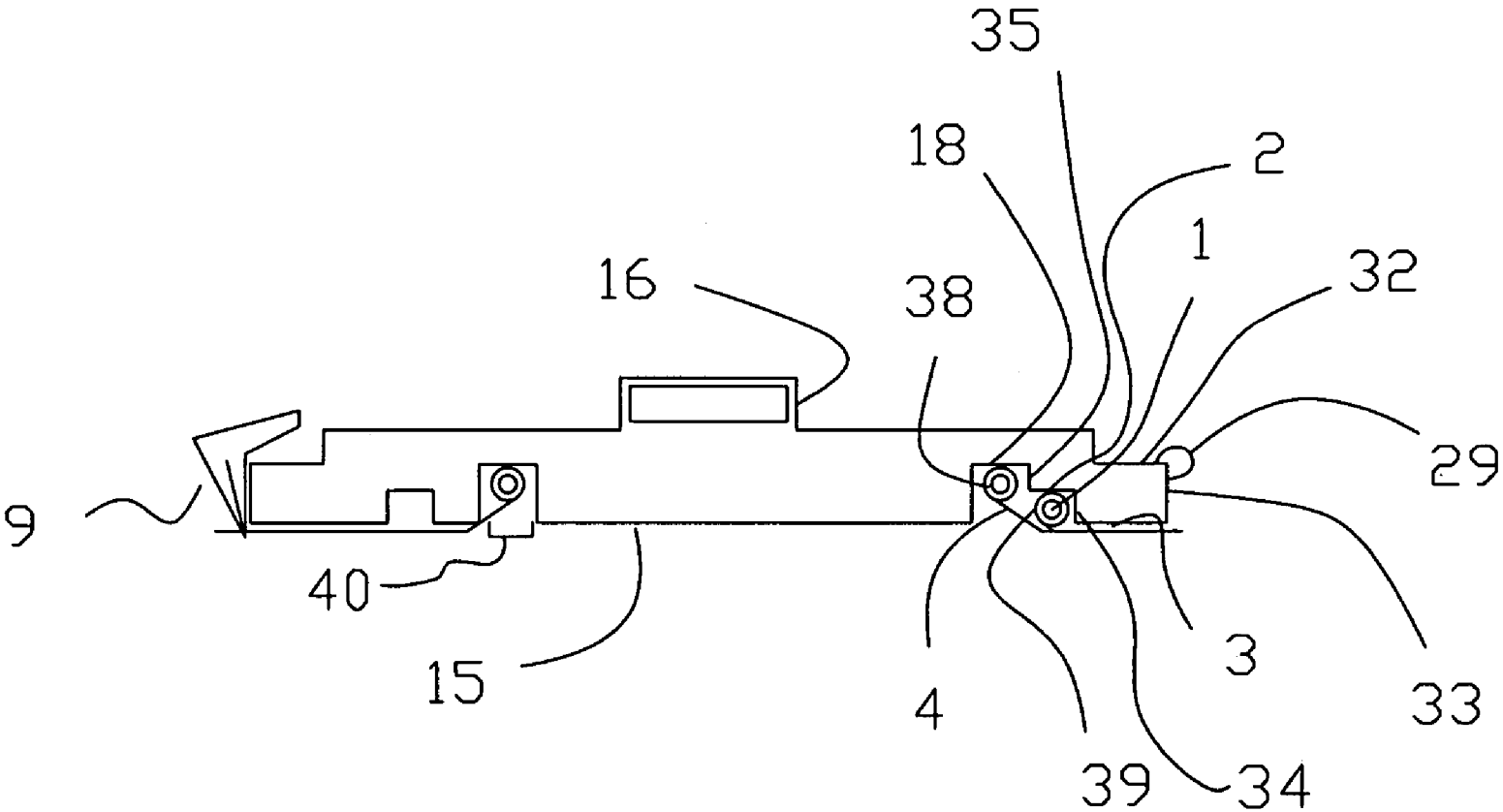
FIG. 3*a* shows a close up of the embodiment of FIG. 3.

In the embodiments shown in FIG. 3*a* there is a step down between the sew cord 38 and the cord 40 defined by step 35. There may be other steps with more sew cords which is not required. This allows a longer sew cord 38 and smaller sew cord 40 at stitch 39 to fit and be held together tightly in a single notch. This allows a tapering off of one sew cord while the other is more tightly held.

Figure 4:
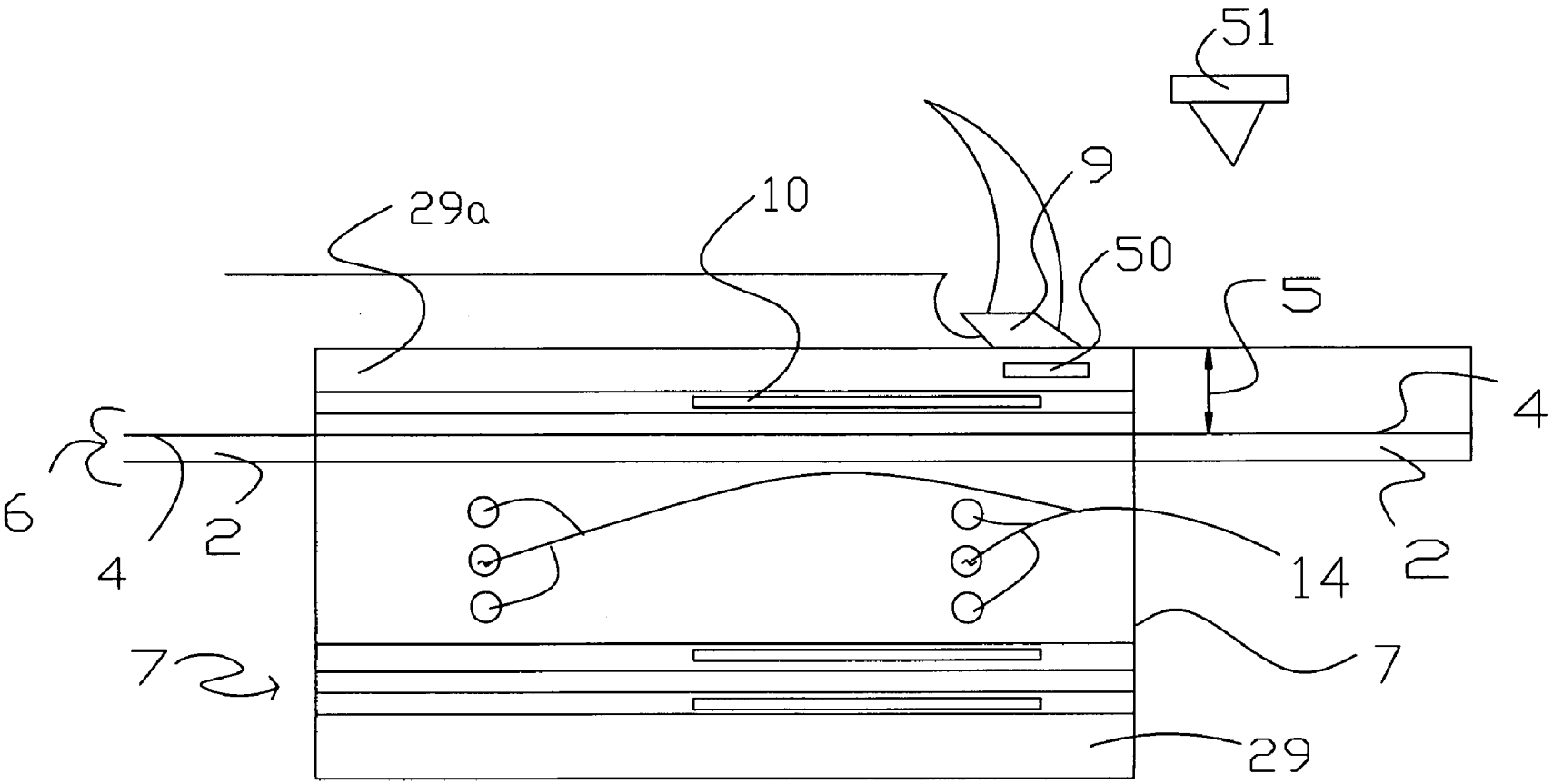
FIG. 4 shows a top view of an alternate embodiment.
Figure 4A:
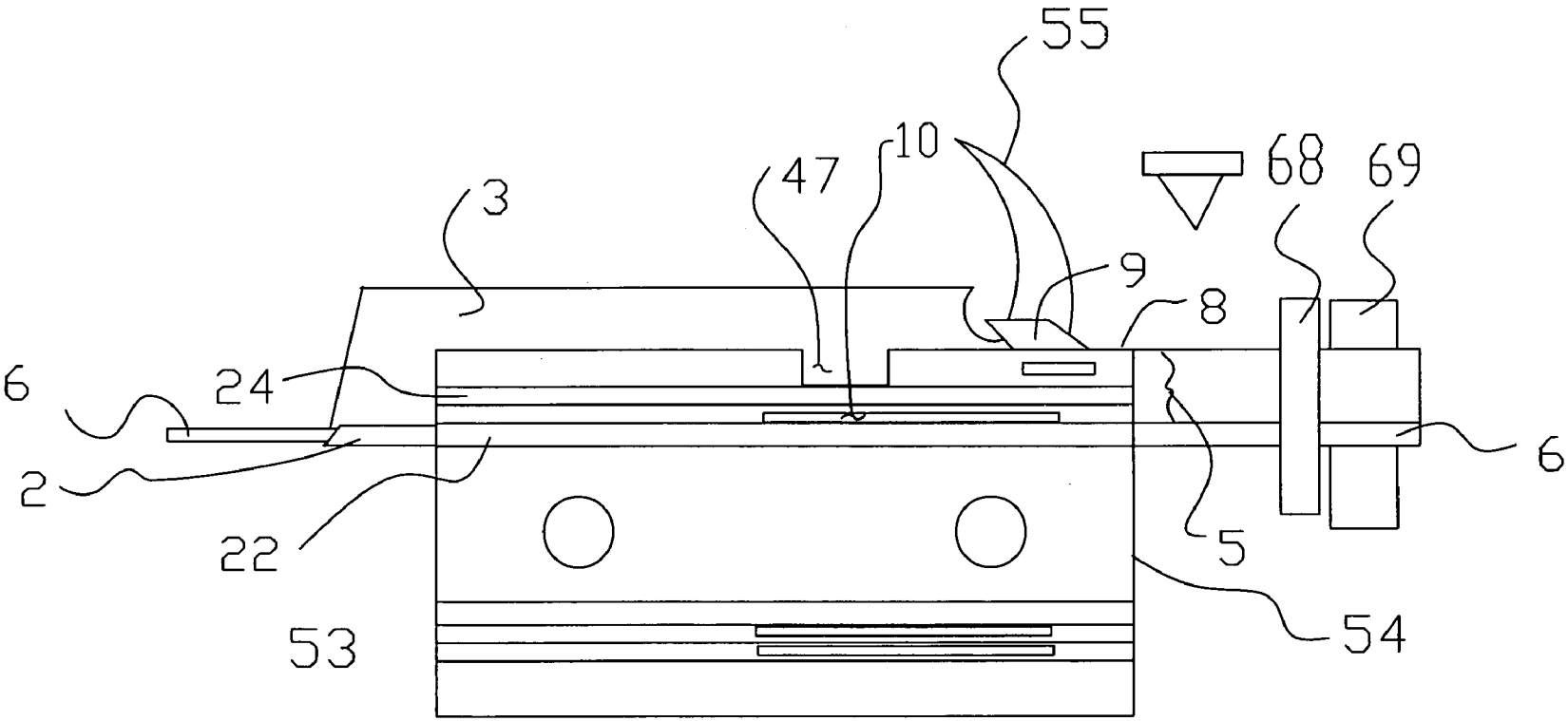
FIG. 4*a* shows the use of two rollers for moving material in conjunction with the embodiment shown in FIG. 4.

This is the most simple embodiment. FIG. 4 shows how this may be used with a sewing slot 10 or cutout 47 as shown in FIG. 4*a* which allows for the material to be simultaneously stitched through stitch slot 10 and cut simultaneously. Many prior art sewing machines incorporate a scissors type cutter for the cutting portion. The blade 9 is shown beside the point to be cut since the particular method of providing a cutting blade is in use in the prior art as a part of sewing machines.

Where this is attached to a sewing machine presser foot post 43, there may be multiple locations, holes 14, for receiving the post 43 as shown in FIG. 4 so that the location of the edges of the body relative to the needle 70 and any scissors 9*a* built into the sewing machine may be adjusted by varying the hole 14 used for attaching the post 43. Alternatively, the post 43 may be movable relative to the needle 70 or relative to any scissors 9*a* (as shown in FIG. 5) which are a prior art part of sewing machines and typically come out of the sewing machine floor 45.

As can be seen by reference to the embodiment in FIG. 4*a* one step in mechanizing the process is to provide a slot and in this embodiment the cord is placed within the fold and this combination is then stuck into the notch and beside the notch is an open slot 10 or cutout 47 through which a sewing needle 70 (shown in FIG. 5) can pass so that the sew cord is sewn in place as the cloth 3 moved along it's length. A cutting blade 9 is also available on the edge 8 so as it is sewn in place, the cuts can be made simultaneously or immediately following the step of stitching the cord within the cloth, here depending on needle placement with in the slot 10.

Rollers 68 and 69 may grip the cloth and pull it from the back 53 of the gauge 7 where the notch 22 may widen to help feed the sew cord 6 to the front where excess cloth 55 is cut away leaving the seam allowances.

Figure 10:
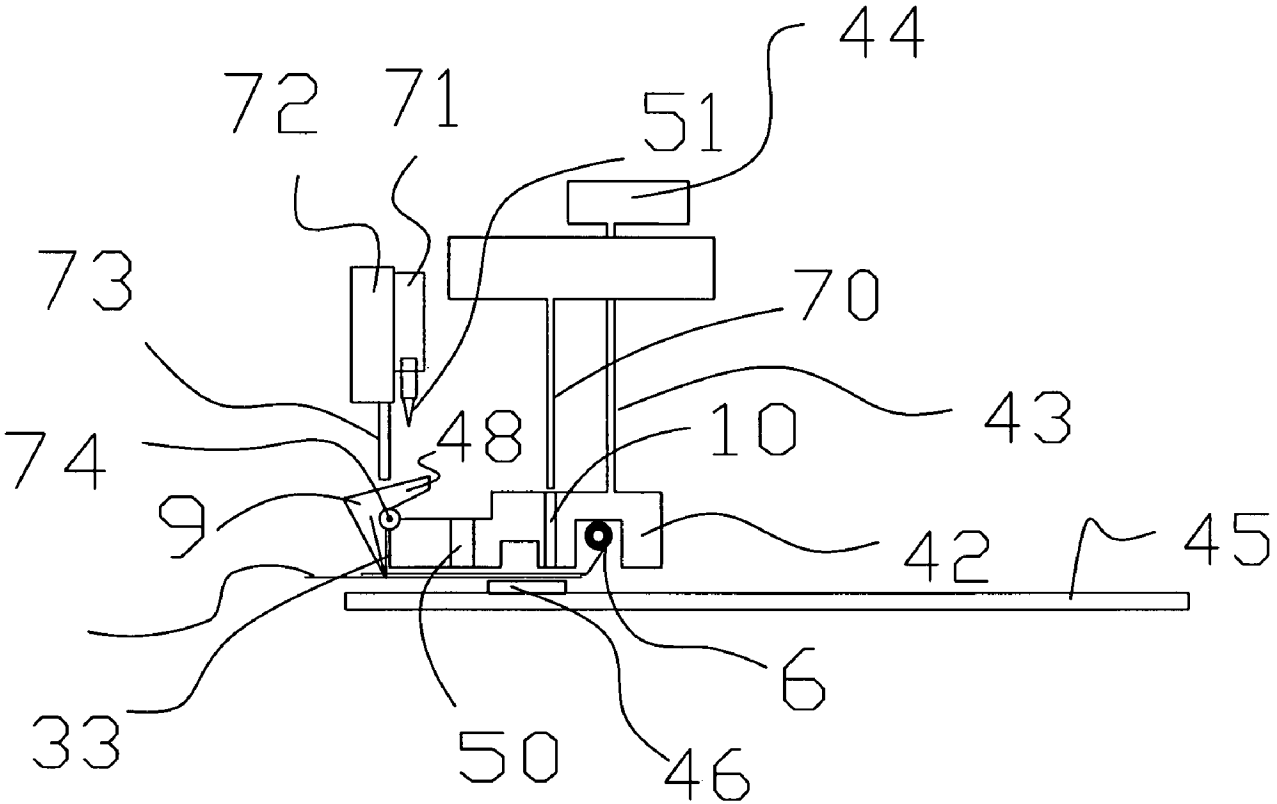
FIG. 10 shows an alternate embodiment where a presser foot is modified to embody the invention.

FIG. 10 shows where a sewing needle 70 may stitch the sew cord together before, after or during the cutting step. Cutting blade 9 may be engaged or disengaged using piston arm 73 behind the pivot 74 on the back 48 of the blade 9 so that the blade is moved around pivot 74 releasing or engaging the cloth 8 so that the cloth is not spaced by the cutting blade such as scissor cut or existing machines. A closer cut may be provided by blade 51 on piston 71 being pushed through opening 50. Blade 51 may be replaced with a second needle to stitch material together after or during the cutting process to have the sew cord attached during the automated process or with a marking pin to mark the location of a later cut to provide an even seam allowances. The location of the opening 10 can be closer or farther from the fold and the location shown is illustrative only. In one embodiment there are holes where screws 19 may be inserted in order to a fix the base over a cutting surface 37 or to a sewing machine in order to allow the devise to be fixed in place and to slide the material between rollers 68 and 69 so that the piping and stitching and cutting may all be preformed simultaneously using automated equipment.

In this case rather than sliding the guide over piping the piping would be slid under the guide and the ends of the seam guide may be curved or smoothed in order to prevent the material from catching and in order to allow a smooth cut.

The seam allowance 5 is important because if it is not perfect, then the pieces of the outfit will not fit together perfectly and in more advanced outfits and more advanced other products utilizing sew cords numerous seams may be used in a single product for structural purposes, effect or both.

Hand marking along the length is inadequate and seams must be made in different lengths of material. Hence, while in the most simple embodiment, only one seam allowance would be provided for, there are at least four different seam allowance measurements desirable in the preferred embodiment made possible by the four notches 20–24 and their distance from one edge 33 of the body 49. While historically seam allowances have been defined using a mark from the completed sew cord (the combination of the cord and the fold), from which the edge 52 of the seam allowance 5 may be cut, as shown in FIGS. 3 and 7 a blade may do this along the edge 33 of the body 49.

Figure 6:
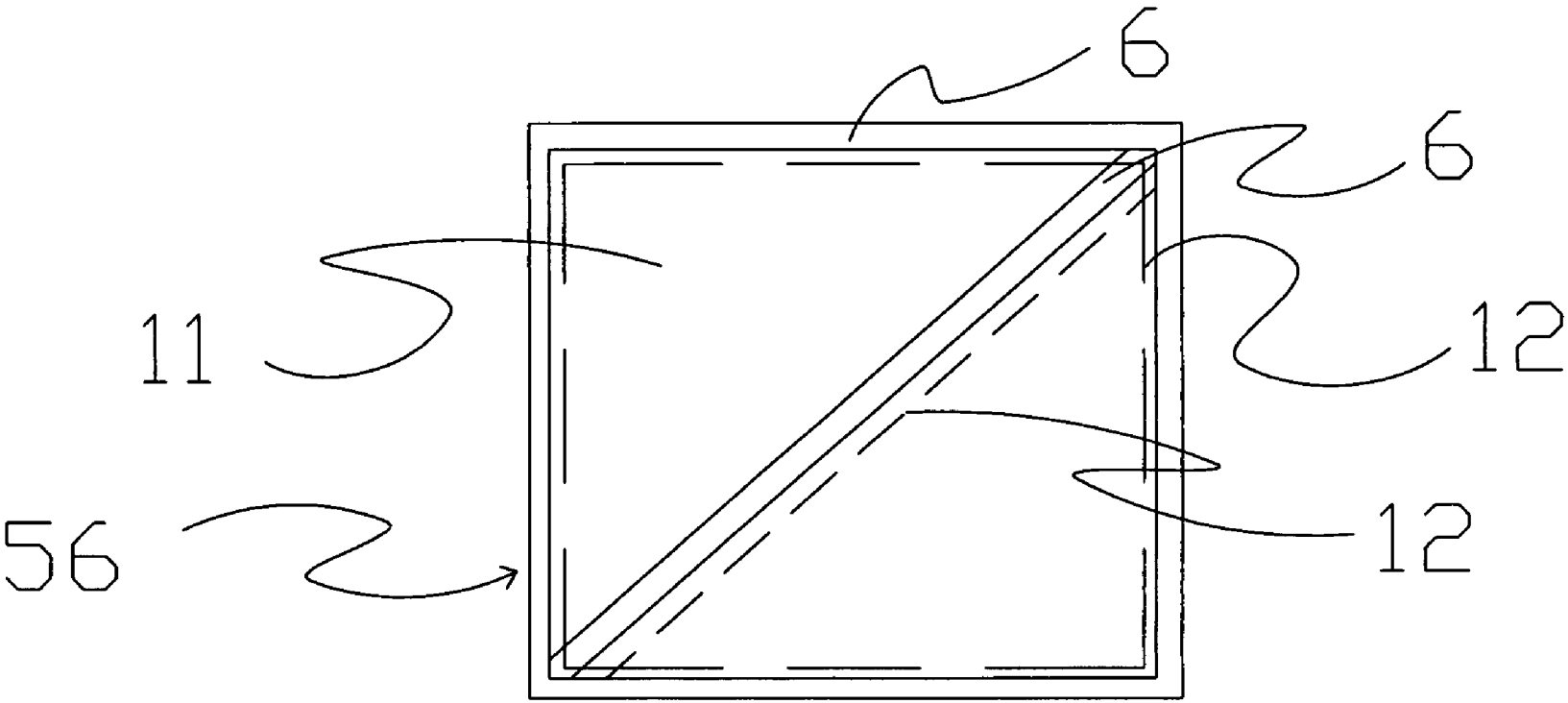
FIG. 6 shows examples of how piping is used.

FIG. 6 shows piping on a pillow 56 where there is a sew cord sewn to the pillow around the edge held by a base stitch and a second sew cord 6 going across the face of the pillow held by a second base stitch 12.

FIG. 7 shows how the cutting blade 9 may be positioned against edge 8. The users hand (not shown) may move along this reduced edge holding the cutting knife in place so that a straight cut is made along the seam allowance or, wheels or the hand may roll or move against wall 13.

Figure 8:
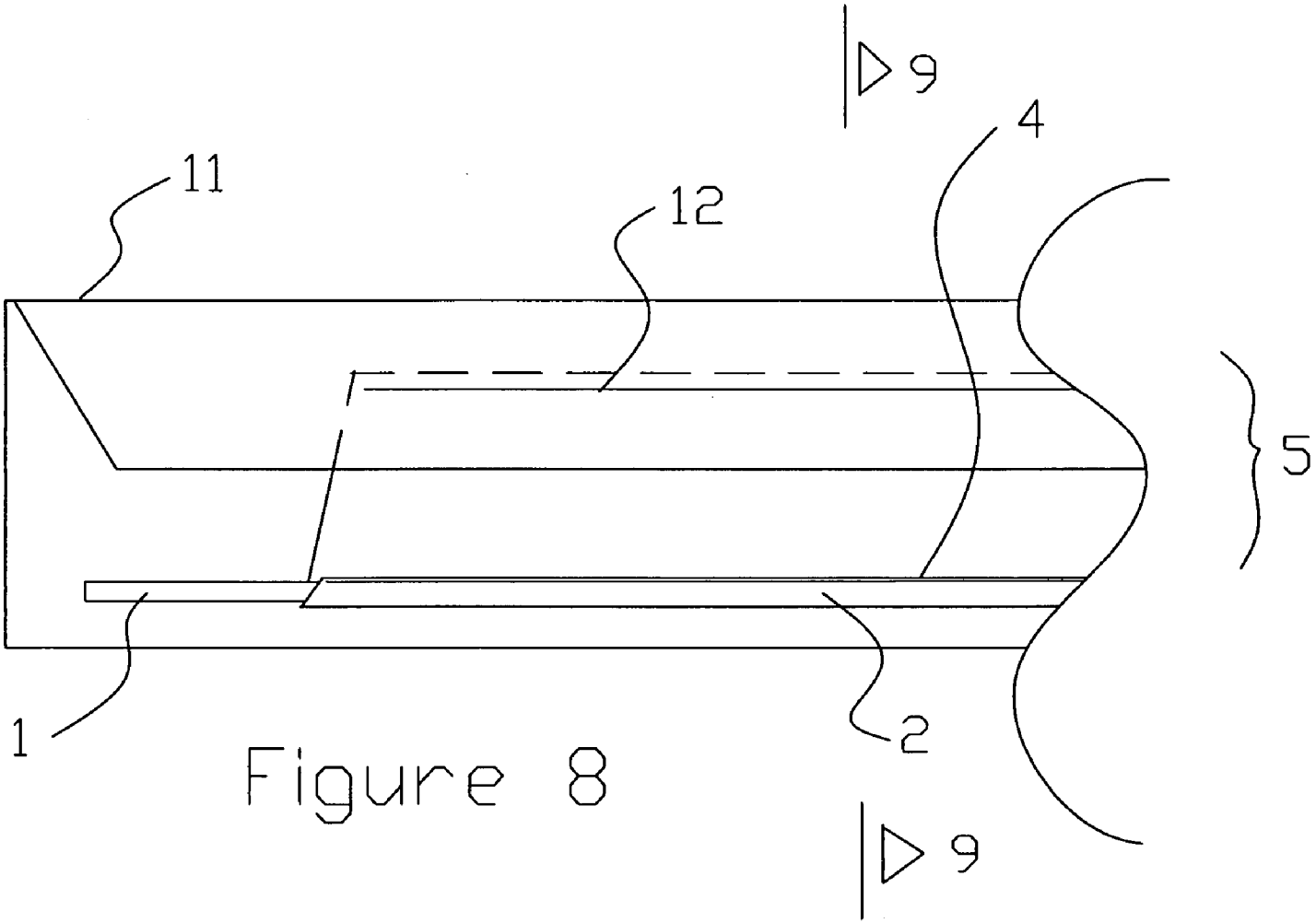
FIG. 8 is a top view with a section of piping.
Figure 9:
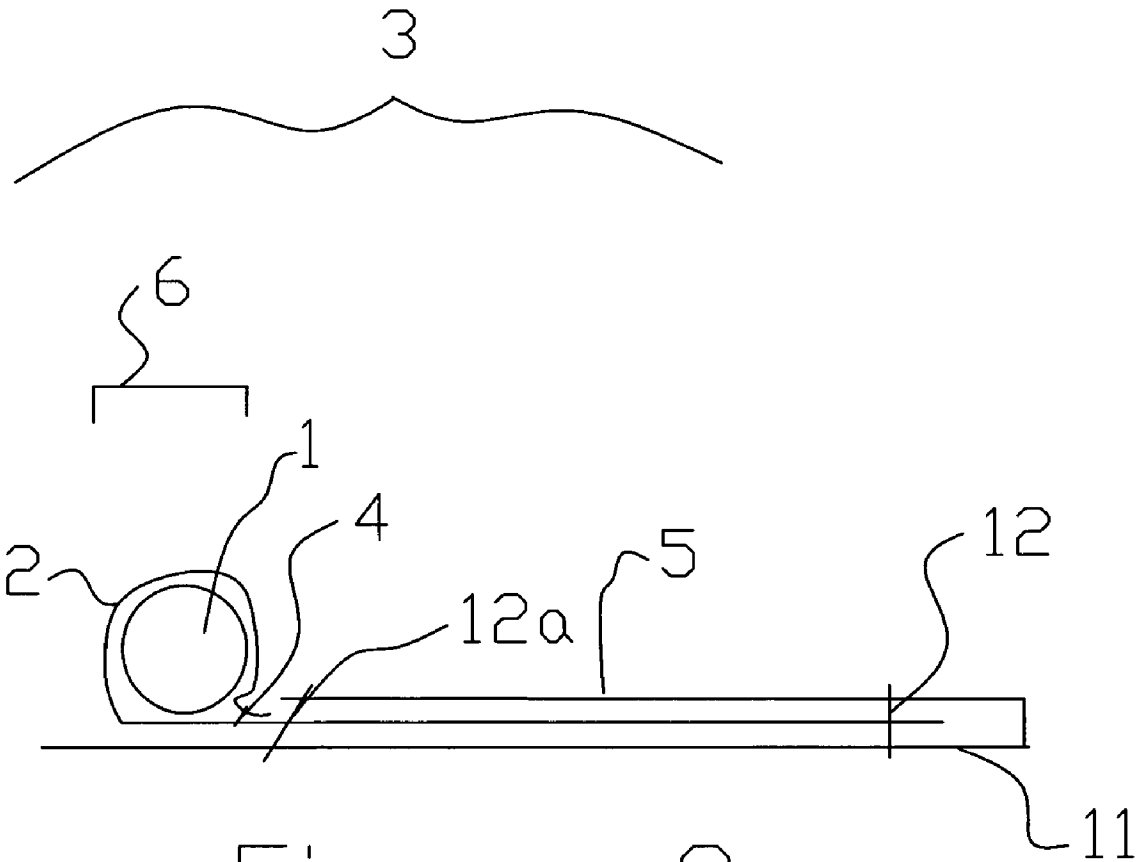
FIG. 9 is an x-section of the piping shown in FIG. 8 through the 9—9 axis.

As can best be seen by reference to FIGS. 8 and 9, in sewing a cord 1 utilized within a fold 2 of a cloth 3 and is held in place by a plurality of cord stitches 4. The length of this cord is defined by the user and may be of any length desired.

As can best be seen by reference to FIG. 10, a presser foot 42, incorporating the features of the invention discussed above, may be specially designed in order to incorporate the invention herein where the presser foot is attached to a presser foot post 43 with the needle 70 going up and down beside it being attached to needle post 44. The attachment of the needle post 44 and foot post 43 to the sewing machine is known in the prior art and is not a part of the invention. As is well known in the prior art the presser foot 42 presses cloth 3 between the foot 42 and the floor 45 of the sewing machine. Here, the tooth dogs 46, also known in the prior art, move the cloth 3 forward after each stitch by needle 70.

The device is an aid for preparing seam allowances in a seam cloth having a thin side forming a seam allowances which has an end which is free and an end which folds over to cover a cord and is sewn together to form an expanded sew cord.

In practice, the finished sew cord is used with a stitching machine, typically a sewing machine, that stitches free end into a fold in the base cloth.

The simple embodiments show a holding means, here the notched body, for mechanically holding the seam cord on at least two (three) sides within the notch while allowing the seam cord to move from the front to back of the body.

The distance between the notch and the edge forms a measuring means for measuring the end of the seam allowance.

At least one cutting blade, two in the case scissors are used, may be used in conjunction with the invention, particularly in the embodiment shown in FIG. 10, where the stitching means (sewing machine) may have scissors built in. In this case or in the case of a stepped edge, the cutting means forms an aligning means for aligning the cutting blade with the seam allowance.

The notch is approximately the same size as the sew cord so that it frictionally holds the sew cord and hence different size notches may be provided for different size sew cords.

As is shown in the preferred embodiments, the base defines a plurality of notches which are at different distances from the edges to allow for different seam allowances, preferably 1/4" and 3/8" from the left edge and ½" and 1" from the right edge.

To follow the cloth as it moves through the notch, the body is transparent in the preferred embodiment and is made of plexiglass or other suitable plastic material.

The alternative designs allowing the seam allowance to be cut as the cloth feeds through the notch may provide that the cutting means is at least one blade attached to the holding means, here the body through a notch or the cutting means is at least one blade attached to the stitching machine. In the preferred embodiment, where the cloth is cut by hand, the blade is guided by the same edge that marks the end of the length of the seam allowance.

While in the preferred embodiment the individual feeds the cloth forward by sliding the body over the sew cord, in other embodiments the sewing machine would have a tooth dog for feeding the cloth forward through the holding means as the cloth is fed through the sewing machine. In such as case, the foot post of the sewing machine may be used to holding the body in place relative to the scissors or needle of the sewing machine or both. In such a case, the mounting of the body would have to be varied or several different bodies would have to be provided to provide for different seam allowances. All of these embodiments, described generally in FIG. 10, are significantly different from the simplified notched body with stepped edges taught in the preferred embodiment.

The invention may be described as a process utilizing the product so described wherein the process is one for producing seam allowances comprising the steps of holding the sew cord below a body having a length and a width, said defining a notch along the length of the body so that the sew cord is held within the notch; moving the sew cord forward along within the notch; cutting the seam cloth at the seam allowance from the edge of the body; and wherein the step of cutting comprises the step of cutting the seam allowance at the edge of the body.

With a sewing machine process, the process may include the steps of simultaneously cutting the seam allowance and sewing the cord within a fold of the seam allowance cloth or sequentially sewing the cord within a fold of the seam allowance cloth and cutting the edge of the seam allowance and sequentially sewing the seam allowance within a fold of the base material. Where the excess seam cloth is cut away, the process may even sequentially include the step of feeding the seam allowance and base cloth between stitching a feeder means.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

What is claimed is:

1. A device for preparing seam allowances in a seam cloth having a front, a back, a length between the front and back, and a thin side forming a seam allowance with a thin end, and an expanded sew cord comprised of a fold in the seam cloth enclosing a cord said seem cord being opposite the seam allowance thin end and said thin end fitting within a fold in a base cloth for use with a stitching machine that stitches the base cloth fold sequentially from front to back as the seam cloth is fed forward with the seam allowance then end folded into the base cloth into the stitching machine said device comprising:

a) a holding means with a front and back for sequentially feeding the sew cord along its length while frictionally holding the sew cord on at least two sides and releasing the sew cord as the sew cord feeds forward through the holding means from back to front;

b) a measuring means for measuring the end of the seam allowance relative to the holding means and wherein the measuring means further comprises a cutting means for aligning a cutting blade with the thin end.

2. The invention of claim 1 further comprising a cutting means for cutting the seam allowance at the end of the seam allowance as the seam cord feeds through the holding means.

3. The invention of claim 2 wherein the cutting means is at least one blade attached to the holding means.

4. The invention of claim 2 wherein the cutting means is at least one blade attached to the stitching machine.

5. The invention of claim 1 wherein the holding means comprises a body (49) having a length and a width and a front and a back and wherein the width defines a left edge on a first side and having a base and wherein the base describes at least one notch running along the base the length of body (49) from front to back and wherein the measuring means is comprised of the left edge.

6. The invention of claim 5 wherein the at least one notch is approximately the same size as the sew cord.

7. The invention of claim 5 wherein the body comprises a top and a bottom and wherein the body defines at least one body slot passing from the top to the bottom of the body and wherein the distance between the notch and the slot is equal to location of the sew cord stitch.

8. The invention of claim 5 wherein the body comprises a top and a bottom and wherein the body defines at least one body slot passing from the top to the bottom of the body and wherein the distance between the notch and the slot is equal to location of the base stitch from the notch.

9. The invention of claim 5 wherein the body comprises a top and a bottom and wherein the body defines at least one body slot passing from the top to the bottom of the body and wherein the distance between the notch and the slot is equal to the location of the thin edge.

10. The invention of claim 5 wherein the distance between the at least one notch and the left edge is equal to the length of the seam allowance.

11. The invention of claim 10 wherein the base defines a plurality of notches comprised of the at least one notch and at least one second notch and wherein the distance between the at least one notch and the left edge is different from the distance between the at least one second notch and the left edge.

12. The invention of claim 11 wherein the body comprises a right edge and wherein the distance between the at least one notch and the left edge is different from the at least one second notch and the right edge and wherein the measuring means further comprised of the right edge.

13. The invention of claim 12 wherein there are at least four notches and wherein the four notches are, respectively, approximately ¼" and 3/8" from the left edge and ½" and 1" from the right edge.

14. The invention of claim 5 wherein the body is transparent.

15. The invention of claim 5 wherein the edge defines a step so that a cutting blade may run along the step and extend downward along the edge.

16. The invention of claim 15 wherein the body has a center between the front and back and wherein the edge and step run from the front of the body to the back of the body.

17. A device for preparing seam allowances in a seam cloth having a front, a back, a length between the front and back, and a thin side forming a seam allowance with a thin end, and an expanded sew cord comprised of a fold in the seam cloth enclosing a cord said seem cord being opposite the seam allowance thin end and said thin end fitting within a fold in a base cloth for use with a stitching machine that stitches the base cloth fold sequentially from front to back as the seam cloth is fed forward with the seam allowance then end folded into the base cloth into the stitching machine said device comprising:

a) a holding means with a front and back for sequentially feeding the sew cord along its length while frictionally holding the sew cord on at least two sides and releasing the sew cord as the sew cord feeds forward through the holding means from back to front;

b) a measuring means for measuring the end of the seam allowance relative to the holding means and wherein the stitching machine has a foot post means for holding a foot and at least one needle means for stitching thread through the cloth and wherein the holding means is attached to the foot post means and wherein the measuring means further comprises a cutting means for aligning a cutting blade with the thin end and wherein the foot post means further comprises a means for changing the seam allowance by moving the holding means relative to the needle of the stitching means.

18. The invention of claim 17 wherein the foot post means further comprises a means for changing the seam allowance by moving the holding means relative to the cutting means.

19. A process for producing seam allowances in a cloth of a desired length for use with a base material which can be folded to create a fold in the base material comprising the steps of:

1) holding the sew cord below a body having a length and a width, said body defining a notch along the length of the body so that the sew cord is held within the notch;

2) cutting the seam cloth at the seam allowance from the edge of the body.

20. The process of claim 19 further comprising the step of moving the sew cord forward along within the notch and repeating steps 1–2 and then repeating all of the steps until the desired length is obtained.

21. The process of claim 19 wherein the step of cutting comprises the step of cutting the seam allowance at the edge of the body.

22. The process of claim 21 further comprising the step of simultaneously cutting the seam allowance and sewing the cord within a fold of the seam allowance cloth.

23. The process of claim 21 further comprising the step of sequentially sewing the cord within a fold of the seam allowance cloth and cutting the edge of the seam allowance.

24. The process of claim 23 further comprising the step of sequentially sewing the seam allowance within a fold of the base material.

* * * * *